US010436551B1

(12) United States Patent
Bradford

(10) Patent No.: US 10,436,551 B1
(45) **Date of Patent: *Oct. 8, 2019**

(54) HOLSTER MOUNTING SYSTEM

(71) Applicant: Richard N. Bradford, Lake Mary, FL (US)

(72) Inventor: Richard N. Bradford, Lake Mary, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/809,335

(22) Filed: Nov. 10, 2017

Related U.S. Application Data

(63) Continuation-in-part of application No. 15/447,220, filed on Mar. 2, 2017, now Pat. No. 10,393,479.

(51) Int. Cl.
*F41C 33/04* (2006.01)

(52) U.S. Cl.
CPC ..... *F41C 33/041* (2013.01); *F41C 33/048* (2013.01)

(58) Field of Classification Search
CPC ..... F41C 33/041; F41C 33/048
USPC ..... 224/669, 547
See application file for complete search history.

(56) References Cited

U.S. PATENT DOCUMENTS 4,667,374 A * 5/1987 Bianchi ..... A41F 9/002 224/667
6,161,741 A * 12/2000 French ..... F41C 33/0227 224/192
6,371,424 B1 * 4/2002 Shaw ..... F16M 11/041 248/187.1
6,685,067 B2 2/2004 French
6,752,299 B2 * 6/2004 Shetler ..... A45F 5/02 224/197
6,817,499 B2 * 11/2004 Martinez ..... B26B 29/025 224/197
6,955,279 B1 * 10/2005 Mudd ..... A45F 5/02 224/197
7,261,264 B2 * 8/2007 Moran ..... A01K 1/0356 24/573.11
7,464,908 B2 * 12/2008 Files ..... F41B 5/066 124/86
8,333,310 B2 * 12/2012 Tages ..... A45F 5/02 224/197
8,973,799 B2 * 3/2015 Ruiz, III ..... F41C 33/048 224/192
9,016,531 B2 * 4/2015 Paugh ..... A45F 5/004 224/162
2007/0023468 A1 * 2/2007 Ford ..... F41C 33/045 224/197

* cited by examiner

*Primary Examiner* — Nathan J Newhouse
*Assistant Examiner* — Lester L Vanterpool
(74) *Attorney, Agent, or Firm* — Terry M. Sanks, Esq.; Beusse Wolter Sanks & Maire, PLLC

(57) ABSTRACT

A mounting system for a concealed carry holster for securing the holster to a storage location. The mounting system uses a belt clip of the holster to attach the holster to a bracket. The bracket has a spring action restraint that cooperates with the belt clip to retain the holster in the mounting system. The restraint is accessible from a front of the holster to allow easy removal from the bracket.

18 Claims, 14 Drawing Sheets

HOLSTER MOUNTING SYSTEM

CROSS-REFERENCE TO RELATED APPLICATIONS

This application is a Continuation-In-Part of U.S. application Ser. No. 15/447,220 filed Mar. 2, 2017, the entirety of which is incorporated by reference.

BACKGROUND OF THE INVENTION

The present invention relates to holsters for handguns and, more particularly, to a system and apparatus for docking the holster at multiple locations without removal of the handgun from the holster.

Many present-day holsters, particularly those used for concealed carry of a handgun, are formed of molded plastic material with each holster being uniquely configured to fit a particular handgun. One example of such a holster is the LightTuck™ Kydex® IWB holster produced by Vedder Holsters LLC of Mount Dora, Fla. The Kydex® material is a thermoplastic acrylic-polyvinyl chloride formulation that can be readily molded to various configurations such as the shape of a handgun. IWB is an industry term for "inside the waistband". This particular holster includes a clip attached to one side that fits over a belt of a person carrying the holster when the holster is placed inside the person's waistband. The Kydex material of the holster has sufficient strength and rigidity to allow the clip to be attached to the holster by screws.

One of the advantages of the above exemplary IWB holster is that the holster can be readily removed from its carry position in the waistband to another location, such as when the person carrying the handgun enters into a vehicle and keeping the handgun in the waistband would be generally uncomfortable due to bending at the waist and pressure from the vehicle seat. In such cases, the person will ordinarily remove the handgun from the holster in order to be able to place the handgun into an accessible location inside the vehicle. Quite often, the person will perform this action before entering the vehicle which can expose the handgun to other persons in the area resulting in a violation of the concealed carry laws.

U.S. Pat. No. 6,685,067 describes one form of holster that can be removed from a belt retention apparatus without removing the holstered handgun from the holster. In this patent, the holster is not for concealed carry but rather of the type that is used by law officers and carried in a fully exposed position. The mechanism for holding the holster to the belt is not of the type that allows it to be readily removable from the belt worn by the law officer. Accordingly, the holster has a spring-loaded mechanism affixed to a side facing the officer with a push-button release extending through a central opening in the belt-worn mechanism. One issue with the disclosed embodiment is that the user has to reach around the holster, i.e., between the holster and the user's body, to press the push-button in order to release the holster from the belt attachment mechanism. This patent also suggests that a second attachment mechanism could be mounted to another surface so that the holster could be connected to the mechanism in a location other than on the user's belt. However, such mounting would create an arrangement in which it is difficult to remove the holster unless there is provided sufficient spacing between the mechanism and the surface in order to allow the user to access the rear of the mechanism with the user's fingers for releasing the holster from the mechanism. Such a mounting arrangement is not desirable, particularly in a vehicle where there is limited space, since it would cause the holster and attachment mechanism to protrude substantially from the surface. In addition, the mechanism described includes multiple parts making assembly complex and increasing the cost of the holster and attachment mechanism.

What is needed is a mounting system for a concealed carry handgun holster that allows the holster to be removed from a user's waistband and attached to an alternate support mechanism without removing the handgun from the holster wherein the alternate support mechanism latches the holster in place in a manner that is easily released and also allows the handgun to be removed from the holster while the holster is attached to the alternate support mechanism.

BRIEF SUMMARY OF THE INVENTION

The present invention comprises a mounting system for an inside the waistband concealed carry holster. The holster is provided with an elongated clip having a first end attached to a side of the holster and having sufficient spring to allow a second end of the clip to slip over a belt to secure the holster to the belt when the holster is placed inside the waistband of a user. The clip has a pair of substantially straight opposed side edges extending between its respective first and second ends with the second end terminating in a finger grip so that the clip can be sprung outward to permit the holster to be removed from the belt by lifting the holster upwardly. When removed from the user, the holster and handgun can be stored in a different and accessible location using a bracket that is configured to receive the clip and hold the holster in a restrained position. The bracket has a generally flat base having a width and a length and a pair of opposed edge members extending along a length of the base on a common surface of the base. Spacing between the edge members is selected such that the opposed edges of the clip fit in generally abutting relationship with the edge members when the clip is engaged in the bracket. The edge members have stops adjacent at least one end to prevent the clip from sliding through the bracket. In a preferred embodiment, the bracket is attached to a surface by one or more screws.

In one form, the bracket includes a spring action restraint integrally formed along one side and having a projection that partially overlays a side of the clip adjacent the restraint. When the clip is placed in the bracket, the projection snaps over an edge of the clip to hold the clip in engagement with the bracket. The user can easily remove the holster from the bracket by pressing on the restrain with a thumb while grasping the holster. In another form, the bracket incorporates an upper restraint that engages a top edge of the clip with a spring action to inhibit the clip from separating from the bracket. In one embodiment, the upper restraint is form with a protruding lip that extends into a slot formed in the upper edge of the clip.

In order to facilitate mounting of the holster on various different sloped surfaces or to have the holster mounted so that the handgun protrudes at an angle from the surface, there is provided a triangular shaped spacer attachable between the bracket and the surface for adjusting the mounting angle of the holster. The spacer has a plurality of holes that are alignable with holes in the bracket at different angles of rotation so that the holster can be arranged for selected accessibility by adjusting the alignment of the holster to the surface.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION OF THE INVENTION

Figure 1:
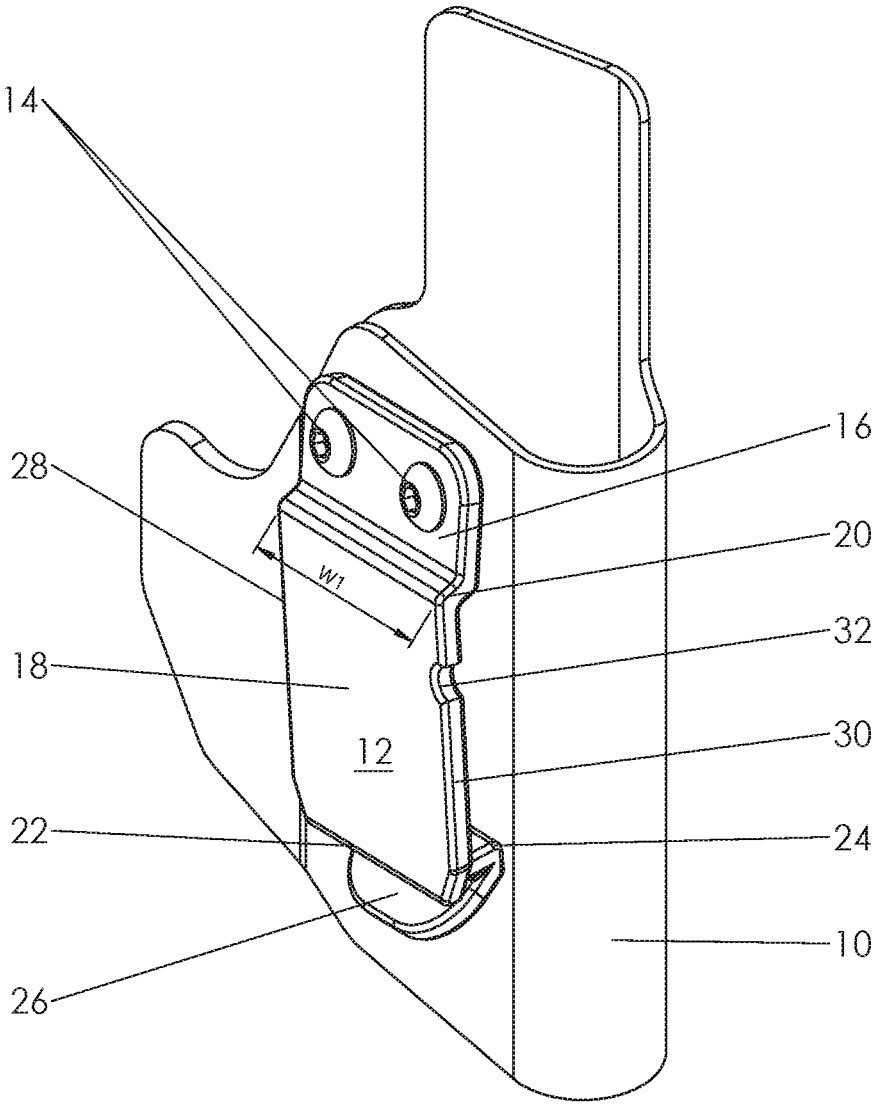
FIG. 1 is a perspective view of one form of IWB concealed carry holster with which the present invention may be used.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Referring to the drawings in general and in particular to FIG. 1, there is shown a perspective view of an inside the waistband (IWB) holster 10 with a side mounted clip 12. The holster 10 is commonly molded of Kydex® acrylic PVC and the clip 12 is attached to the holster using threaded fasteners such as machine screws 14. The clip 12 has a first end 16 that is offset from the major portion 18 by a riser 20. A second end 22 of the clip is formed with a depending portion 24 that is re-curved to form a finger lift 26 so that the user can lift the second end of the clip in order to remove the holster from its coupling to a belt worn by the user. The clip 12 is preferably molded of the same material as the holster, e.g., Kydex® acrylic PVC, but could be molded of other types of plastic material having generally equivalent strength and rigidity. The clip 12 has sufficient bendability and plastic memory to allow it to be used to hold the holster to a belt passing under the clip and to be removed from the belt by lifting the second end 22 using the finger lift 26 by an amount that will allow the depending portion 24 to pass over the belt when it is desired to remove the holster.

As seen in FIG. 1, the clip 12 has a defined width W1 and a pair of opposed side edges 28, 30 extending from the first end 16 to the second end 22. Preferably, both of these side edges are parallel and substantially perpendicular to the ends 16, 22. However, the side edges do not necessarily have to be parallel and could be arranged angularly to form an inverted, truncated triangle shape. The desired feature is that at least one of the side edges is generally straight for the purpose to be described below with regard to FIG. 2. A detent or cutout 32 is formed in edge 30 at a predetermined location that will become apparent in the description of FIG. 2.

Figure 2:
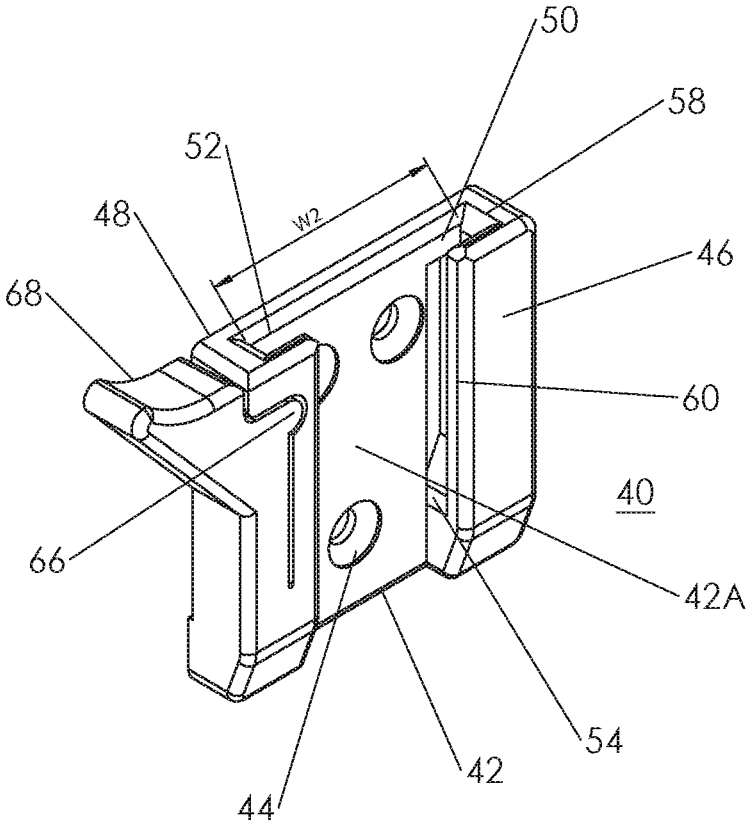
FIG. 2 is a front perspective view of a one form of bracket for use with the holster of FIG. 1.
Figure 3:
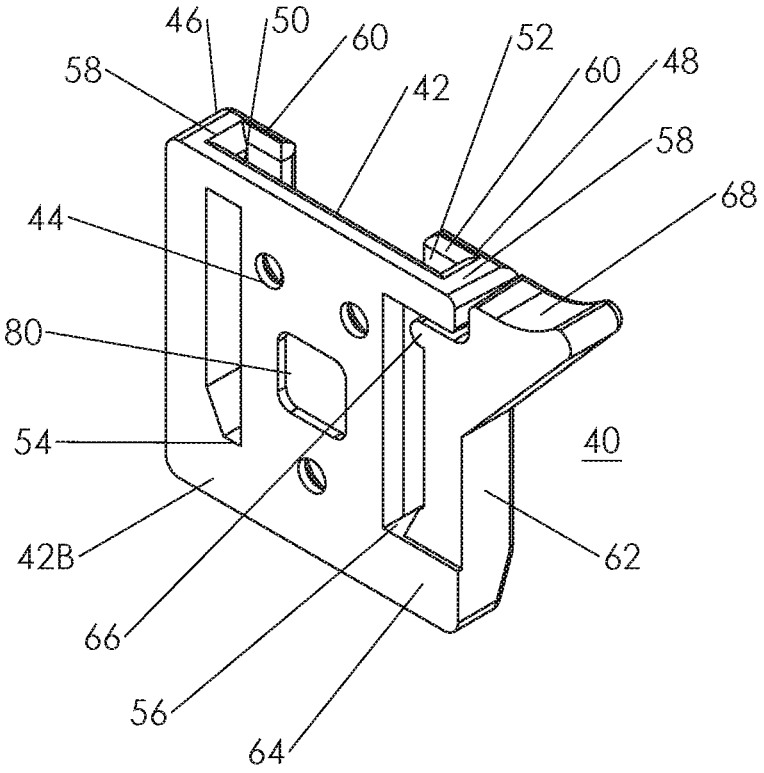
FIG. 3 is a rear perspective view of the bracket of FIG. 2.

Turning now to FIGS. 2 and 3, there is shown a front perspective view and a rear perspective view, respectively, of one embodiment of a bracket 40 that can be used to mount the holster 10 to a surface such as a portion of a dashboard of an automobile. The bracket 40 is specifically designed so that it can be injection molded from Kydex® or numerous other types of plastic material having sufficient structural strength to perform the intended function. While not a preferred material, it is also possible to construct the bracket 40 as well as the clip 12 from a metal such as aluminum using techniques well known in the art. The bracket comprises a generally flat back plate or base 42 having a front surface 42A and a rear surface 42B and further having a plurality of holes 44 for passage of fasteners, such as screws, (not shown) for attaching the plate to a surface (not shown) such as a portion of the dashboard of an automobile or a side of a piece of furniture or an appliance or any other area where a handgun might be stored when not being carried in a waistband. The plate/base 42 has a pair of opposed edge members 46, 48 extending along a length of the base on the front surface 42A. In the embodiment of FIGS. 2 and 3, each of the edge members 46, 48 define respective slots 50, 52 for slidably receiving the opposed edges 28, 30 of the clip 12 to retain the clip in engagement with the bracket. Each of the slots 50, 52 are formed with respective stops 54, 56 at bottom ends thereof to prevent the clip from sliding through the bracket. The width indicated at W2 corresponds to the width indicated at W1 of the clip 12 but with W2 being slightly wider that W1 so that the clip can be readily inserted and removed from the bracket. Each of the slots 50, 52 are defined by a forwardly extending segment 58 and a return segment 60 that are molded in situ with base 42. The segment 58 defines a space of sufficient depth to accept the thickness of the clip 12 in sliding engagement with the bracket 40.

The edge member 48 is constructed differently from the edge member 46 in that the member 48 includes a spring action restraint 62 attached to the member 48 at a lower portion 64 of the bracket 40. The restraint 62 is shaped such that a major portion extends along member 48 and forms a continuation of the segment 58 defining an edge of the slot 52 but is separated from the return segment 60. Near an upper end of the restraint 62 there is formed a catch 66 that is configured and arranged to extend into the slot 52 so as to engage the detent 32 when the clip is inserted into the bracket. As mentioned above, the edge with the detent is preferably straight so that it slides easily against the catch 66 when the clip 12 is inserted in the slots 50, 52. In order to release the clip 12 from the bracket 40, pressure is applied to the thumb extension 68 to cause the restraint 62 to pivot away from the slot 52 and disengage the catch 66 from the detent 32 whereby the restraint acts as a clip release member when it is desired to remove the holster from the bracket. The physical location of the detent 32, catch 66 and the bottom stop 56 are dimension so that the catch engages the detent when the clip 12 is pushed into the slot 58 and bottoms against the stop 56. A corner of the clip 12 that engages the catch 66 during insertion of the clip into the bracket may be tapered so that the catch is pushed laterally and rides along the edge of the clip until it reaches the detent.

Figure 4:
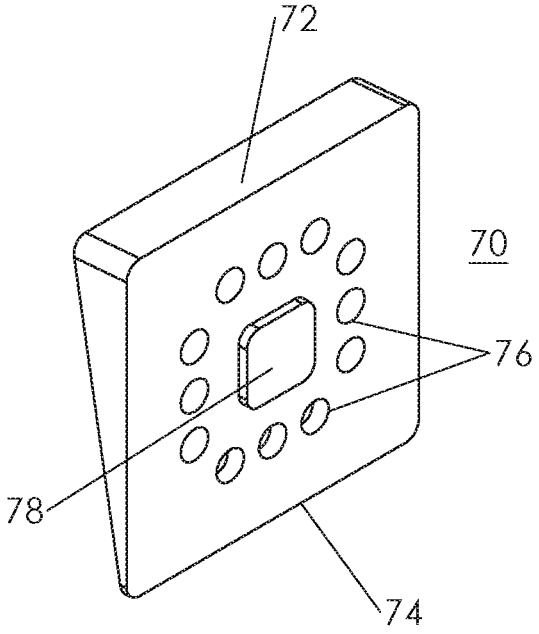
FIG. 4 is a perspective view of a spacer particularly adapted for use with the bracket FIG. 2.

In mounting the bracket 40 it may be desirable to adjust the angle at which the holster is positioned when attached to the bracket. For example, it may be desirable for the handle of a handgun in the holster to be angled away from a mounting surface in order to facilitate grasping of the handle when the holster in attached to the bracket. FIG. 4 illustrates one form of a spacer 70 that can be used with the bracket 40 to change the angle at which the holster is oriented. Spacer 70 is essentially a wedge tapering from an upper end 72 to a lower end 74. A plurality of holes 76 are formed in the spacer in a generally circular pattern and arranged in such a manner that at least three of the holes 76 align with the holes 44 regardless of the orientation of the spacer. This arrangement allows the holster to be tilted along different axes at the preference of the user by merely changing the orientation of the spacer. The alignment of the holes 44 and 76 allows screws or other fasteners to pass through the bracket 40 and spacer 70 for mounting to a surface. If desired, the spacer may be formed with a raised pedestal 78 that has a selected shape, such as the illustrated rectangular shape, that will engage the rectangular opening 80 in the bracket 40 so as to limit the number of possible orientations of the holster while providing a more secure connection between the bracket 40 and spacer 70.

Referring again to FIG. 3, it can be seen in this rear perspective view that there are two cutouts or openings 82 and 84 passing through the bracket base 42. Each opening 82, 84 aligns with a respective one of the return segments 60. During the molding process, an extension of a surface of the mold (not shown) extends through each of the openings 82, 84 with an outer end of the extension forming a surface against which the return segment 60 is formed. A moveable portion of the mold extends downward a short distance to engage the extensions and create the upper portion of the slots 50, 52. The return segment 60 of each edge member 46, 48 is formed to have a width corresponding to the width of the openings 82, 84 but having a length greater than the length of an associated opening 82, 84. This arrangement reduces the amount of plastic material needed to form the bracket and, more importantly, limits the range of motion of the moveable portion of the mold into the slots so that the moveable portion is easily withdrawn when the slots are formed.

Figure 5:
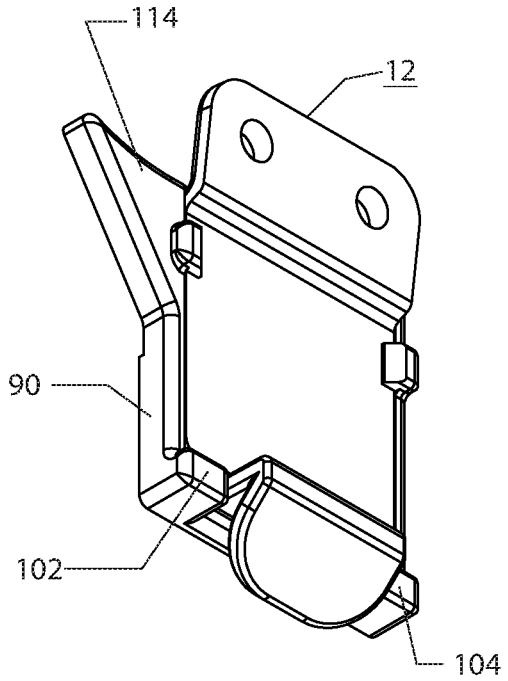
FIG. 5 is a perspective view of another form of bracket and clip assembly for use with an IWB holster.
Figure 6:
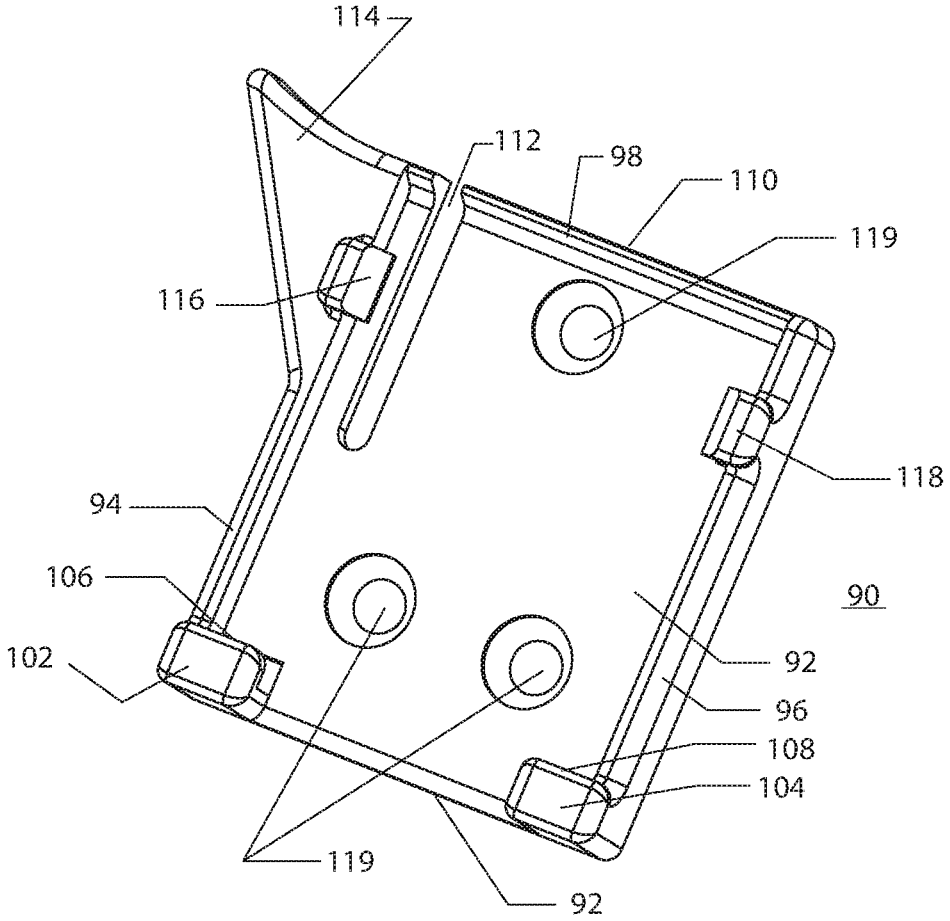
FIG. 6 is a perspective view of the bracket of FIG. 5.
Figure 7:
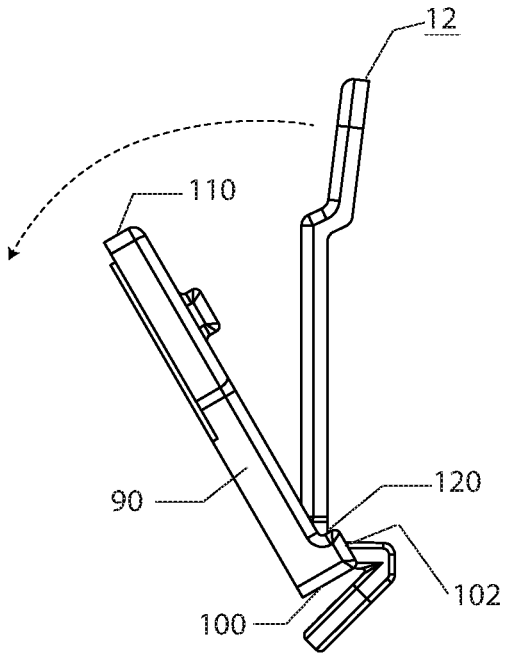
FIG. 7 is side elevation view of the assembly of FIG. 5 with the clip partially disengage.
Figure 8:
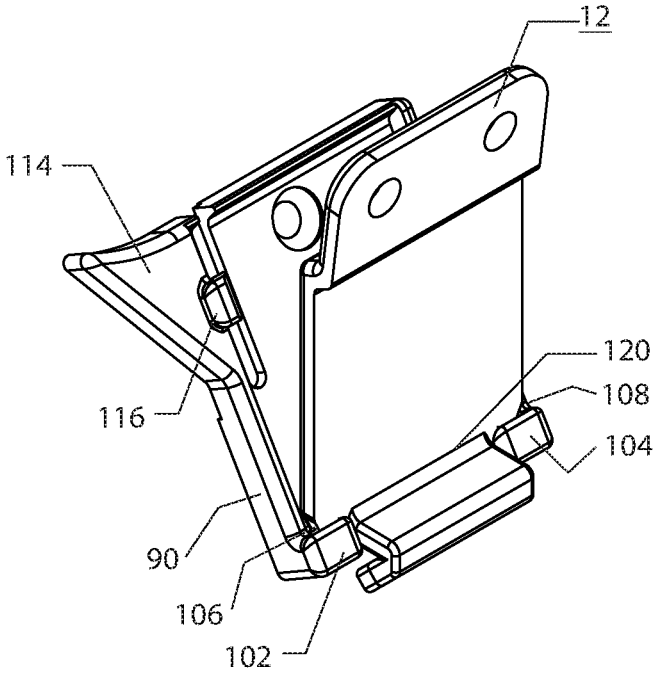
FIG. 8 is a front perspective view of the assembly of FIG. 7.

Turning now to FIGS. 5, 6, 7 and 8, there is shown another embodiment of the invention in which the clip 12 is supported by a bracket 90 and can be removed from the bracket by tilting of the clip rather than sliding upward as is necessary with the bracket of FIG. 2. The bracket 90 is defined by a back plate 92 having a pair of opposite side members 94, 96 and a top edge member 98. The members 94, 96 and 98 function as edge guides and restraints for the clip 12 and extend generally perpendicularly from the back plate 92 to form essentially a three-sided box for receiving the clip. In the illustrative form, the members 94, 96 have a height measured from the back plate 92 that is approximately the same as the thickness of the clip 12. At the lower end 100 of the bracket, the plate 92 includes a pair of corner members 102, 104 that extend above the side members 94, 96 and have a return portion 106, 108, respectively, that overlay a corner of the clip 12 when the clip is positioned in the bracket. As shown in FIG. 8, a slot 112 is formed in the back plate 90 and extends from the top edge 110 through the top edge member 98 downward to about half the length of the bracket. The length of the slot is selectable and only needs to be sufficiently long to allow the triangular extension 114 to pivot slightly outward. The extension 114 is integral with the bracket 90 and can be molded with the bracket. The extension 114 is formed as a finger pull such that downward pressure on the extension causes the extension to pivot outward. A latch 116 is formed as part of the extension 114 and protrudes outwardly with a return portion extending laterally into the position overlaying an adjacent edge of the clip 12 when the clip is pivoted into the bracket as shown in FIG. 5. The sizing of the latch 116 is selected so that the small pivoting movement of the extension 114 is sufficient to pull the latch out of its restraining position with respect to clip 12. A mating latch 118 can be molded as part of the side member 96 to provide additional restraint for the clip 12. In practice however, it has been found that the single latch 116 is sufficient to hold the clip in the bracket.

As shown in FIGS. 7 and 8, insertion of the clip 12 into the bracket 90 is achieved by placing the lower end 120 of the clip into the bottom of the bracket such that the lower corners of the clip are positioned behind the return portions 106, 108 of the lower corner members 102, 104 of the bracket. The clip is then tilted upward so that the edges of the clip push the latches 114, 116 outward so that the clip snaps into position behind the latches. The clip 12 is removed from the bracket by applying finger pressure to the extension 114 to cause the latch 114 to move out of engagement with the clip while concurrently tilting the clip outward to the position shown in FIG. 8.

The bracket 90 can be attached to any surface in the same manner as the bracket 40 of FIG. 2. As with bracket 40, the angular spacer 70 can be used to adjust the angle of the bracket so as to hold the holster at a convenient angle for removal from the bracket.

Figure 9:
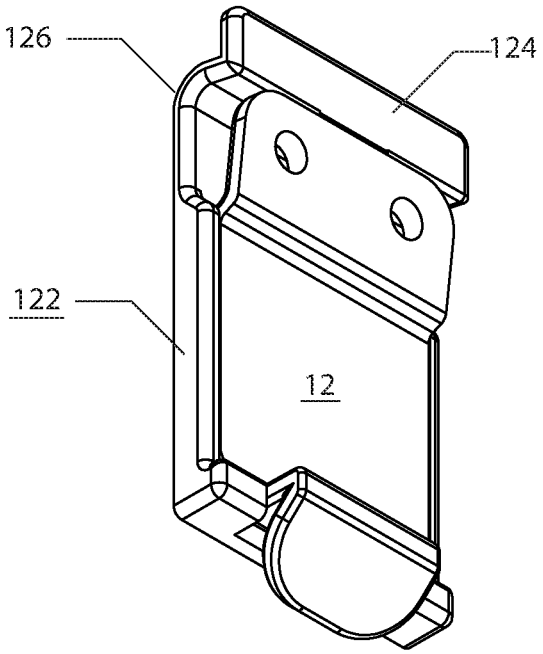
FIG. 9 is a perspective view of still another form of bracket and clip assembly for use with an IWB holster.
Figure 10:
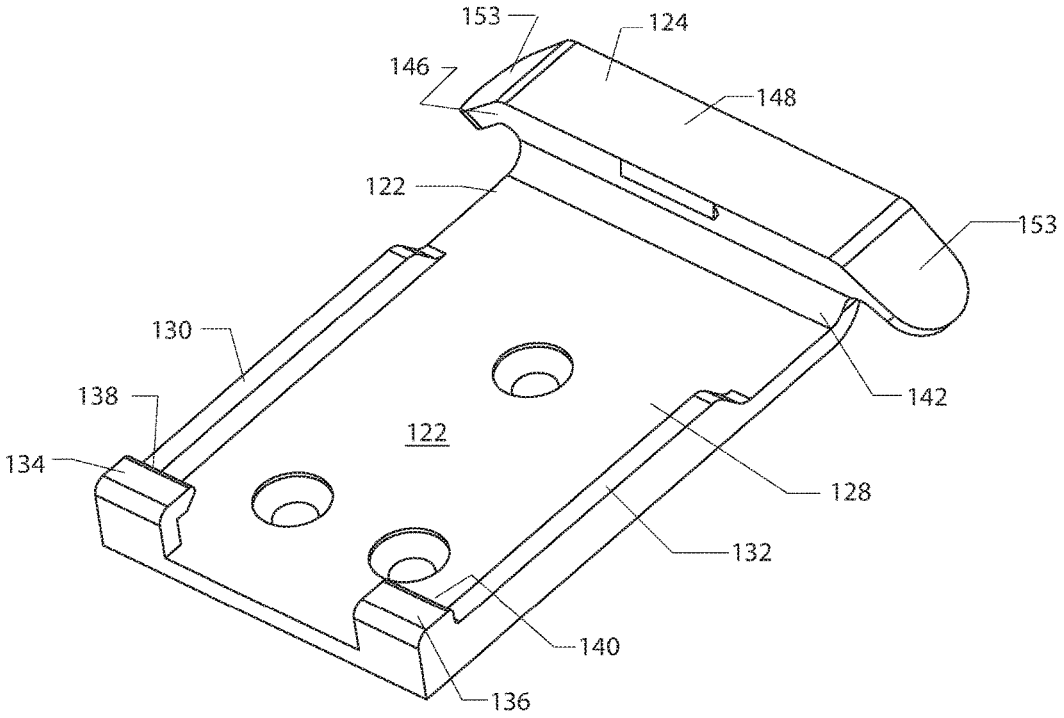
FIG. 10 is a perspective view of the bracket shown in FIG. 9.

Another embodiment of bracket for holding a standard IWB holster clip is shown in FIGS. 9, 10, 11 and 12. In FIG. 9 the clip 12 is shown in a perspective view upon insertion into a bracket 122. Clip 12 is held in place by a snap-in fit with an upper extension 124 that is formed with a generally L-shape extending from an upper end 126 of the bracket 122. As can be seen in the side view of FIG. 11, the extension 124 is formed as a continuation of a back plate 128 that forms the major extent of the bracket 122. The plate 128 is similar to the plate 92 of FIG. 5 and has a pair of opposite side edge members 130, 132, best seen in FIG. 10, that extend generally perpendicularly from the plate 128. There are also lower corner members 134, 136 extending from plate 128, each having a respective short return edge 138, 140 that is generally parallel to the plate 128 so that when the clip 12 is placed in the bracket 122 the lower edge of the clip is captured between the plate 128 and the edges 138, 140. The side edge members 130, 132 abut against the side edges of clip 12 to prevent sideways movement of the clip in the bracket.

Figure 11:
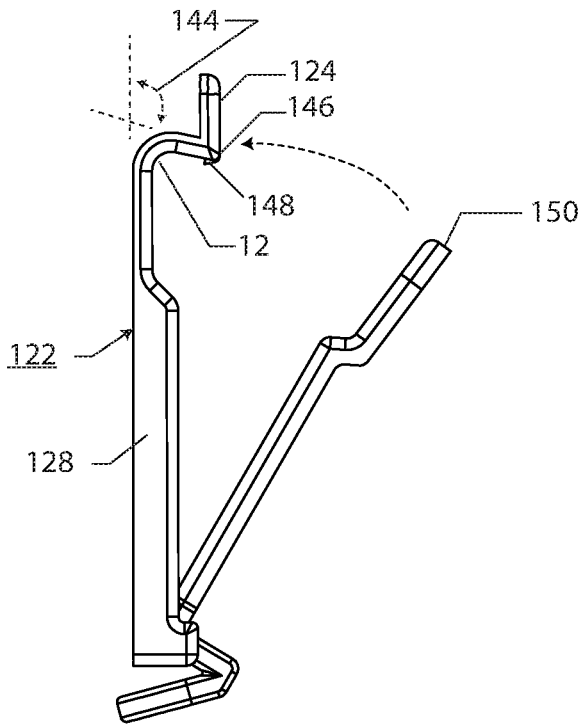
FIG. 11 is a side elevation view of the bracket and clip assembly of FIG. 9 with the clip partially disengaged.
Figure 12:
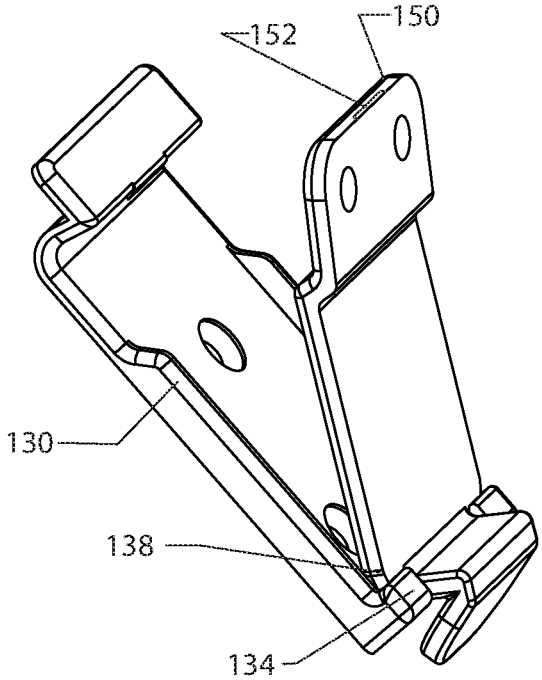
FIG. 12 is a front perspective view of the assembly of FIG. 11.

The L-shaped extension 124, see FIG. 11, is formed with a curve at 142 that has an angle 144 that is slightly greater than ninety degrees. At the corner 146 of the extension 124 there is formed a short rib 148 extending along the corner and protruding generally toward the lower end of the bracket 122. The rib 148 is located to intersect with a top edge 150 of the clip 12 when the clip is pressed into the bracket 122, essentially acting as a catch to hold the clip in the bracket. In one embodiment, a groove 152 can be formed in the top edge 150 in a position to receive the rib 148 when the clip 12 is pressed into the bracket. As with the embodiment shown in FIGS. 5, 6, 7 and 8, the clip is inserted into the bracket by placing the lower end of the clip into the lower end of the bracket and tilting the clip towards the bracket until the rib engages the groove. Due to the flexibility of the L-shaped extension 124, the clip 12 is removable from the bracket 122 by tilting the clip away from the extension 124 to release the clip from the rib 148. The L-shaped extension 124 will bend about the curve 142 to allow the rib to release the clip.

Figure 13:
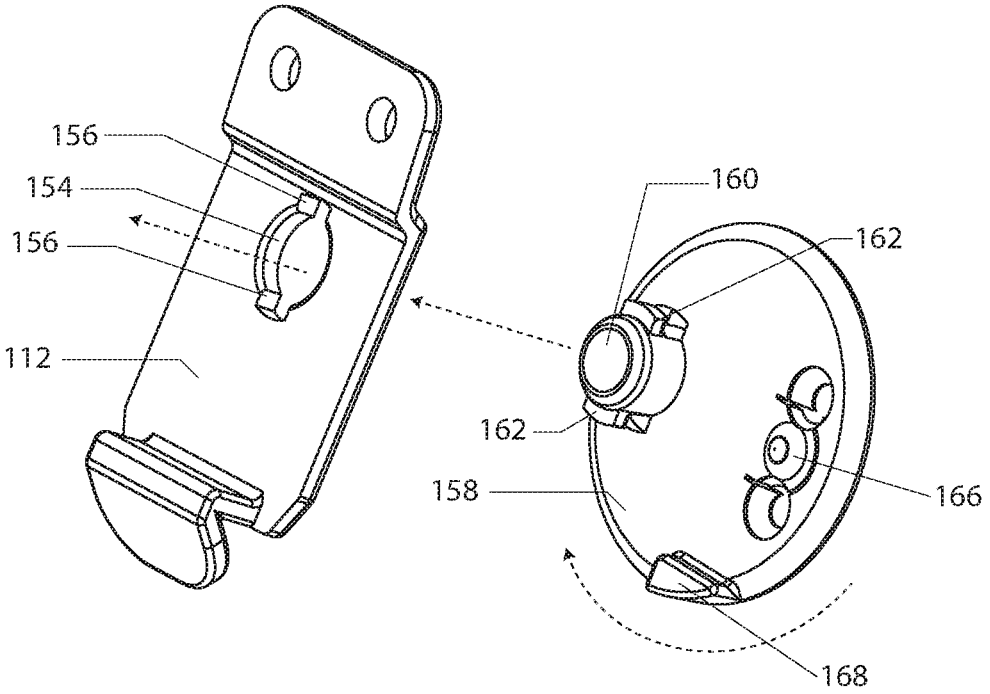
FIG. 13 is an exploded view of another form of bracket and clip assembly for use with an IWB holster.
Figure 14:
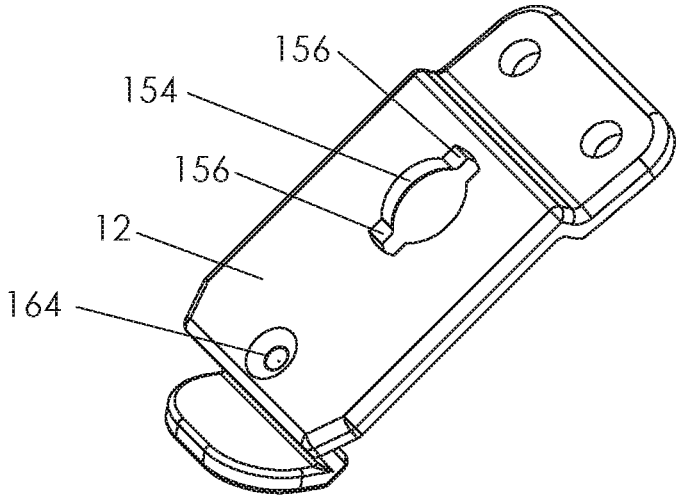
FIG. 14 is a perspective of a reverse side of the clip shown in FIG. 13.

Still another embodiment of a bracket and clip assembly is shown in FIG. 13 and a reverse side of the clip of FIG. 13 is shown in a perspective view in FIG. 14. In this embodiment, the clip 12 is modified by adding a circular or cylindrical opening 154 having a pair of oppositely extending slots 156. A bracket 158 is formed with an extending circular or cylindrical member 160 having a pair of oppositely extending pins 162 sized to fit the slots 158. This arrangement creates a form of bayonet mount. As described in Wikipedia, a conventional bayonet mount is a fastening mechanism consisting of a cylindrical male side with one or more radial pins, and a female receptor with matching L-shaped slot(s) and with spring(s) to keep the two parts locked together. The slots are shaped like a capital letter L with a short upward segment at the end of the horizontal arm; the pin slides into the vertical arm of the L, rotates across the horizontal arm, then is pushed slightly upwards into the short vertical segment by spring action; the connector is no longer free to rotate unless pushed down against the spring until the pin is out of the upward segment. In the application of FIG. 13, the spring action is provided by the flexibility of the clip 12. However, the clip does not include the convention vertical segment but relies on friction between the edges of the pins 162 and the surface of the clip 12. If desired, a detent 164 (a shallow recess with tapered sides) can be incorporated in the clip 12 and a mating protrusion 166 formed on the bracket 158 so that when the protrusion engages the detent, there is an additional force to prevent rotation of the bracket with respect to the clip. There may also be provided a raised projection 168 along the edge of the bracket 158 to limit the rotation of the clip 12 when attached to the bracket. The projection 168 abuts against a side edge of the clip 12 as the clip is rotated into connection with the bracket 158 to prevent over rotation.

While the invention has been described in what is presently considered to be a preferred embodiment, various modifications and adaptations will become apparent to those skilled in the art. By way of example, the clip could be attached to a case for a knife or a flashlight and therefore be used to mount the knife or flashlight to a surface, either in a vehicle or a building. It is intended therefore that the invention not be limited to the specific disclosed embodiment but be interpreted within the full spirit and scope of the appended claims. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

The invention claimed is:

1. A bracket for use in mounting of a holster for supporting a handgun having a rear side of a clip mounted to the holster for coupling the holster to a belt of a user inside a waistband of the user such that the holster may be easily removed from the bracket, the bracket comprising:

a flat base including a front side having a width and a length and a pair of opposed bracket edge members extending along a length of the base on the front side of the base, the opposed bracket edge members having first and second stops at a bottom end of the flat base to prevent the clip from sliding through the bracket and the opposed bracket edge members comprise perpendicularly raised extensions extending perpendicularly to the front side of the flat base for a height configured to accommodate the thickness of the clip wherein the first stop in space relation with the second stop;

a restraint formed integrally with the bracket along a portion of a lateral side being perpendicular to the opposed bracket edge members at a top end of the flat base opposite the bottom end for restraining the clip to the bracket; and means for attaching the flat base of the bracket to a surface whereby the holster can be mounted to the surface by engaging a front side of the clip between the raised extensions on the front side of the flat base of the bracket.

2. The bracket of claim 1, wherein the clip comprises a groove and the restraint is a spring action restraint which extends laterally between the pair of opposed bracket edge members for access from a front of the bracket and comprising a catch configured to engage the groove to restrain the clip in the bracket.

3. The bracket of claim 2, wherein the restraint forms at least a portion of a laterally edge of one of the pair of opposed bracket edge members.

4. The bracket of claim 1, and including a spring action restraint, the spring action restraint comprises an extending finger grip attached to a portion of the flat base, the portion of the flat base being formed by a slot formed in the flat base and extending parallel and in proximity to one of the opposed bracket edge members and the spring action restraint sufficient to allow the portion to be bent away from a remaining portion of the flat base.

5. The bracket of claim 4, and including a catch coupled to the portion and located at the one opposed edge member for engaging an edge of the clip for retraining the clip in the bracket, the edge of the clip being parallel to and in proximity to the one opposed edge members.

6. A mounting system for a holster comprising:

an elongated clip comprising a major portion having a pair of opposed clip side edges, a first end having a rear side configured to mount to a side of the holster and being offset and depending from the major portion, a second end opposite the first end and depending from the major portion and at least two lateral sides perpendicularly arranged relative to the pair of opposed clip side edges, wherein the major portion of the clip being configured to spring to allow the second end and the major portion to lift and slip over a belt to secure the belt under a rear side of the major portion;

a bracket comprising:

a flat base including a front side having a width and a length and a pair of opposed bracket side edges extending along at least a portion of the length of the base, each of the bracket side edges comprising perpendicularly raised extensions along the front side for engaging a portion of a corresponding opposed clip edge of the major portion to inhibit sideways movement of the clip in the bracket, a first stop and a second stop in spaced relation at a bottom end of the flat base to prevent a lower lateral side of the at least two lateral sides and the major portion of the clip from sliding through and out of the bottom end of the flat base of the bracket, and means for restraining the clip along a length of a respective one lateral side of the at least two lateral sides of the clip in the bracket, the respective one lateral side being different from the lower lateral side; and means for attaching a rear side of the flat base opposite the front side to a surface whereby the holster can be mounted to the surface by engaging the clip into the bracket.

7. The mounting system of claim 6, and including a spring action restraint operatively associated with the bracket and having a projection extending therefrom for engagement with the clip to inhibit accidental release of the holster from the bracket.

8. The mounting system of claim 7, and wherein the spring action restraint includes an outwardly extending restraint release member accessible to release the clip from the bracket.

9. The mounting system of claim 8, wherein the means for attaching includes a plurality of bracket holes formed in the flat base of the bracket and a corresponding plurality of screws for attaching the bracket to the surface.

10. The mounting system of claim 8, and including a latch wherein the restraint release member is formed integrally with the bracket and is defined by a separation between the bracket and the restraint release member and wherein applying finger pressure to the restraint release member to cause the latch to move out of engagement with the clip while concurrently tilting the clip outward.

11. The mounting system of claim 8, wherein the outwardly extending restraint release member extends form one of the opposed bracket side edges of the bracket and the respective one lateral side of the at least two lateral sides of the clip in the bracket, being a top lateral side of the major portion and being different from the lower lateral side.

12. The mounting system of claim 6, and including a spacer attachable between the bracket and the surface for adjusting a mounting angle of the bracket securing the clip attached to the holster.

13. The mounting system of claim 12, wherein the spacer is rotatable with respect to the bracket for adjusting alignment of the holster relative to the surface.

14. The mounting system of claim 6, wherein the second end of the clip comprises an inwardly extending portion for anchoring the clip to the belt and a finger grip so that the clip can be sprung outward to permit the clip and the attached holster to be removed from the belt.

15. The mounting system of claim 14, wherein the finger grip being narrower than the major portion and a gap between the first stop and the second stop being dimensioned to receive therebetween the finger grip while corners of the major portion are supported within the first stop and the second stop.

16. The mounting system of claim 6, wherein the respective one lateral side of the at least two lateral sides of the clip comprises a groove and the restraining means comprises top end extension formed integrally with and depending form the flat base at a location opposite the bottom end of the flat base, the releasably restraining means configured to catch the groove.

17. The mounting system of claim 6, and including a spring action restraint, the spring action restraint comprises an extending finger grip attached to a portion of the flat base, the portion of the flat base being formed by a slot in the flat base and extending parallel and in proximity to one of the opposed bracket side edges.

18. The mounting system of claim 17, and including a second catch coupled to the portion and located at the one opposed bracket side edges for engaging a proximal clip side edge of the clip for restraining the clip in the bracket, the proximal clip side edge being parallel to and in proximity to the one opposed bracket side edge and wherein the spring action restraint to allow the portion to be bent away from a remaining portion of the flat base such that release of the spring action restraint latches the clip within second catch of the bracket.

* * * * *